United States Patent [19]

Wingo Jr

[11] Patent Number: 4,926,503

[45] Date of Patent: May 22, 1990

[54] ATHLETIC SHOCK ABSORBING PAD

[75] Inventor: James C. Wingo Jr, Houston, Tex.

[73] Assignee: Riddell, Inc., Chicago, Ill.

[21] Appl. No.: 373,501

[22] Filed: Jun. 30, 1989

Related U.S. Application Data

[62] Division of Ser. No. 193,840, May 13, 1988.

[51] Int. Cl.[5] ..... A41D 27/26

[52] U.S. Cl. ..... 2/267; 2/2; 5/481

[58] Field of Search ..... 2/2, 20, 16, 22, 23, 2/24, 267, 268; 5/448, 461, 464, 468, 481; 36/37, 71

[56] References Cited

U.S. PATENT DOCUMENTS

| | | | |
|---|---|---|---|
| 2,917,843 | 12/1959 | Scholl | 36/37 |
| 3,044,075 | 7/1962 | Rawlings | 2/267 |
| 3,047,888 | 8/1962 | Shecter | 5/481 |
| 3,534,417 | 10/1970 | Boyles | 5/464 |
| 3,553,749 | 1/1971 | Majeske | 5/481 |
| 4,100,620 | 7/1978 | Pecoraro | 2/2 |
| 4,128,902 | 12/1978 | Siebert | 2/2 |
| 4,451,996 | 7/1984 | Norton | 36/71 |
| 4,486,901 | 12/1984 | Donzis | 2/2 |
| 4,700,403 | 10/1987 | Vacanti | 2/267 |
| 4,723,322 | 2/1988 | Shelby | 2/16 |

FOREIGN PATENT DOCUMENTS

| | | | |
|---|---|---|---|
| 0070701 | 1/1983 | European Pat. Off. | 5/481 |
| 1133622 | 7/1962 | Fed. Rep. of Germany | 5/481 |
| 2125514 | 12/1971 | Fed. Rep. of Germany | 5/481 |
| 8102384 | 9/1981 | Int'l Pat. Institute | 5/464 |
| 8004755 | 3/1982 | Netherlands | 5/481 |
| 1572159 | 7/1980 | United Kingdom | 2/22 |

*Primary Examiner*—Werner H. Schroeder
*Assistant Examiner*—Diana L. Biefeld
*Attorney, Agent, or Firm*—Ben D. Tobor

[57] ABSTRACT

An athletic shock absorbing pad structure includes a flexible open-celled foam member disposed in a flexible enclosure and the flexible open-celled foam member comprises two layers of open-celled foam, the density of the layers of open-celled foam being different from one another.

4 Claims, 3 Drawing Sheets

ATHLETIC SHOCK ABSORBING PAD

RELATED APPLICATIONS

This application is a divisional application of application Ser. No. 193,840, filed May 13, 1988, entitled Cantilever Strap for Football Shoulder Pads.

FIELD OF THE INVENTION

The invention relates to a cantilever strap for football shoulder pads and other types of athletic shock absorbing pads, and includes a shock absorbing pad structure.

DISCUSSION OF THE PRIOR ART

In the sport of football, the football players wear protective gear generally comprised of structural members lined with padding, such as shoulder pads. Conventional shoulder pads are bilaterally symmetrical and are generally comprised of right and left body arch members which extend over the shoulders and include anterior and posterior portions, or depending chest and back portions, which overlie the chest and back of the athlete. The posterior portions, or depending back portions may be permanently hinged together on a vertical axis over the athletes's back or spine, while the interior portion, or depending chest portions, are connected together on a vertical line over the athlete's sternum as by means of straps or lacing. Typically, conventional shoulder pads also utilize a pad body disposed beneath the body arch members, and the pad body is either fixedly secured, or releasably secured, to the body arch members. The structural members, such as the body arch members, as well as conventional shoulder cups and epaulets are manufactured from a suitable class of material having the requisite strength characteristics to withstand the forces of impact incurred in the playing of the game of football.

Conventional football shoulder pads also include a strap of material which has its ends fixedly secured to the body arch member, as by rivets, or other suitable connectors, whereby one end of the strap is secured to the depending chest portion of the body arch member, and the other end of the strap is secured to the depending back portion of the body arch member. Typically, these straps are referred to as cantilever straps, and they support the body arch members in a spaced relationship from the pad body, as well as from the shoulder of the football player. In many instances, during the playing of the game of football, a force will be exerted upon the shoulder pads of the football player, and in particular, the body arch members, whereby the force of impact forces the body arch members downwardly. Simultaneously, the shoulders of the football player are moving upwardly toward the body arch member, whereby the shoulder of the football player disposed beneath the shoulder portion of the pad body contacts the cantilever strap as the cantilever strap "bottom out" and strikes the football player's shoulder.

Conventional cantilever straps have always been made and used having a width of anywhere from approximately one and one-half to two inches wide. The structure of the football player's body, specifically, his shoulder, which is contacted by the cantilever strap is generally called the acromioclavicular area of the football player's shoulder. This acromioclavicular area, is generally referred to as the "A.C." area, and relates to the football player's clavicle and the acromion which is the lateral extension of the spine of the scapula, which forms the highest point of the shoulder. In general, the acromioclavicular area of the football player's shoulder extends from the base of the football player's neck downwardly towards the tip of his shoulder, or deltoid muscle. With prior art shoulder pads, having cantilever straps which are generally approximately two inches wide, upon the cantilever straps bottoming out upon the football player's shoulder, and specifically abutting the acromioclavicular area of the football player's shoulder, the cantilever straps transmit the force of impact to the acromioclavicular area of the football player's shoulder.

Because of the high forces of impact which can be encountered when playing the sport of football, many football players have suffered injuries to the shoulders, and specifically the acromioclavicular area of their shoulders. It is believed that many of these shoulder injuries are due to the fact that the high force of impact is not only transmitted to the acromioclavicular area of the football player's shoulder by the cantilever straps, but because of the size, and specifically the width, of conventional cantilever straps, the force of impact is concentrated over the area of the central portion of the cantilever strap which overlies the acromioclavicular area of the football player's shoulder. It is further believed that the concentration of the energy from the forces of impact transmitted to the acromioclavicular area of the football player's shoulder by the conventional cantilever strap causes such shoulder injuries. It should be noted that due to the nature of the sport of football, as well as other contact sports, no protective equipment, such as shoulder pads, can prevent injuries; however, it is believed that such equipment can be designed to attempt to better protect the player from injuries.

Accordingly, prior to the development of the present invention, there has been no football shoulder pad having cantilever straps which has been better designed to protect the football player to attempt to minimize the occurrence and severity of injuries to the shoulders, and in particular, injuries to the acromioclavicular area of a football player's shoulder. Therefore, the art has sought a football shoulder pad having cantilever straps which has been designed to attempt to better protect the football player from the occurrence and severity of injuries to his shoulders, and particularly the acromioclavicular area of the football player's shoulder.

SUMMARY OF THE INVENTION

In accordance with the invention, the foregoing advantages have been achieved through the present shoulder pad for a football player. The present invention for a shoulder pad having: body arch members, which each include depending chest and back portions; a pad body disposed beneath the body arch members; and cantilever straps secured to the body arch members to support the body arch members in a spaced relationship from the pad body, the cantilever straps each including a central portion thereof which overlies the acromioclavicular area of the football player's shoulder is the improvement wherein the central portion of each cantilever strap, which overlies the acromioclavicular area of the football player's shoulder is substantially greater in width than two inches, whereby the force from an impact upon a body arch member is transmitted to the acromioclavicular area of the football player's shoulder by the cantilever strap, and the force is dispersed over the area of the central portion of the cantilever strap which overlies the acromioclavicular area of the football player's shoulder.

Another feature of the present invention is that the central portion of each cantilever strap which overlies the acromioclavicular area of the football player's shoulder is at least three inches in width. A further feature of the present invention is that the central portion of each cantilever strap which overlies the acromioclavicular area of the football player's shoulder is approximately four inches in width. An additional feature of the present invention is that each of the cantilever straps may have an upper and lower surface, and a shock absorbing pad is disposed upon each lower surface and overlies the acromioclavicular area of the football player's shoulder.

Another feature of the present invention is that each shock absorbing pad may comprise two layers of open-celled foam, the density of the layers of the open-celled foam being different from one another. Each shock absorbing pad may comprise at least one layer of open-celled foam, disposed within a heat-sealed nylon enclosure.

A further feature of the present invention is that each cantilever strap may have first and second portions depending from the central portion, the first depending portion being secured to the depending chest portion of a body arch member, and the second depending portion may be secured to the depending back portion of a body arch member. Each depending portion of each cantilever strap being angularly disposed with respect to the central portion of the cantilever strap and depends downwardly and inclined toward the other body arch member.

The cantilever straps of the present invention for use with a conventional football shoulder pad, when compared with previously proposed prior art cantilever straps and shoulder pads, has the advantages of being designed to attempt to better protect the football player from the occurrence and severity of injuries to his shoulder, and in particular, to the acromioclavicular area of the football player's shoulders.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
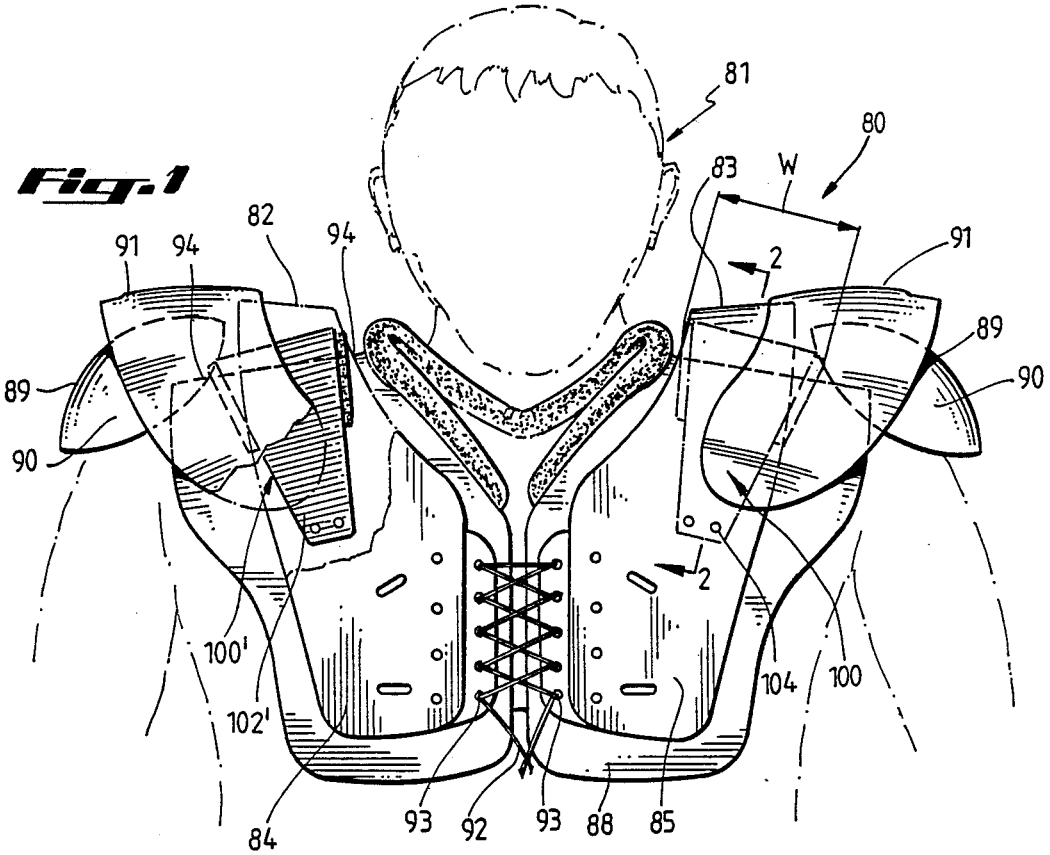
FIG. 1 is a front view of a conventional shoulder pad for a football player having the improved cantilever straps in accordance with the present invention.

In FIG. 1, a conventional shoulder pad 80 for a football player 81 (shown in dotted lines) is shown to generally comprise left and right body arch members 82,83, each body arch member including depending chest portions 84,85 and depending back portions 86 (FIG. 2.), 87 (not shown), the shoulder pad 80 being bilaterally symmetrical. Conventional shoulder pad 80 typically also includes a pad body 88 disposed beneath the body arch members 82,83, which pad body is either fixedly secured or releasably secured, to the body arch members 82,83. The shoulder pad 80 may also be provided with conventional shoulder cups 89 which overlie the deltoid muscles 90 of the football player 81, as well as conventional epaulets 91 are attached to the body arch members 82,83. As is well known in the art, depending back portions 86,87 of body arch members 82,83 may be permanently hinged together on a vertical axis over the football player's 81 back or spine, while the depending chest portions 84,85 are connected together on a vertical line over the football player's sternum as by a lacing 92 passing through lace openings 93 provided on the depending chest portions 84,85 of body arch members 82,83. Body arch members 82,83, as well as shoulder cups 89 and epaulets 91 are made of any suitable material, such as a suitable plastic, having the requisite strength and rigidity requirements to withstand the forces of impact incurred in the sport of football, as is well known in the art. In this regard, it should be noted that although the present invention is being described in connection with a football shoulder pad 80, the present invention could likewise be used in protective pads of similar construction which are worn by athletes for other contact sports, such as hockey.

Conventional football shoulder pads 80 are provided with conventional cantilever straps (not shown) which may vary in width from one and one-half to two inches, and have a central portion (not shown) which overlies the acromioclavicular area 94 of the football player's 81 shoulder. With reference now to FIGS. 1–5, an improved cantilever strap 100 in accordance with the present invention will be described.

As seen in FIGS. 1–5, cantilever strap 100 includes a central portion 101 which overlies the acromioclavicular area (hereinafter "A.C." area) of the football player's shoulder, and first and second portions 102,103 depending from the central portion 101 of cantilever strap 100. The first depending portion 102 is secured to the depending chest portion 85 of a body arch member, such as body arch member 83 and the second depending portion 103 is secured to the depending back portion 86 of body arch member 83. Any suitable connection means, such a rivets 104, may be utilized. Preferably, cantilever strap 100 is made of a pliable and flexible material having the necessary strength characteristics to withstand the forces exerted upon the cantilever strap 100, such a suitable nylon material or heavy-duty vinyl webbing material.

Still with reference to FIGS. 1–5, the cantilever strap 100 secured to the body arch member 83 whereby the body arch member 83 is supported in a spaced relationship from the pad body 88, as well as the cantilever strap 100 being disposed in a spaced relationship from pad body 88. As previously described, upon a force from an impact upon the body arch member 83, the body of the football player 81 with pad body 88 thereon will move upwardly, as shown by arrow 106 in FIG. 2, and body arch member 83 and cantilever strap 100 secured thereto will move downwardly in the direction of arrow 107 shown in FIG. 2, until the central portion 101 of cantilever strap 100 will bottom out and abut against pad body 88, which in turn is abutting against the shoulder, or A.C. area 94 of football player 81.

In accordance with the present invention, the width W (FIGS. 1, 4, and 5) of central portion 101 of cantilever strap 100 is substantially greater than two inches, whereby the force from an impact upon a body arch member 83 is transmitted to the A.C. area 94 of the football player 81, and the force is dispersed over the area A of the central portion 101 of the cantilever strap 100 which overlies the A.C. area 94 of the shoulder of the football player 81. In accordance with the present invention, a width which is substantially greater than two inches would be approximately at least three inches in width, and in accordance with the preferred embodiment of the present invention, the width W of the central portion of each cantilever strap 100 which overlies the A.C. area 94 of the shoulder of the football player should be approximately four inches in width. Assuming that the length L (FIG. 3) of the central portion 101 of cantilever strap 100, as well as the length of the central portion of a conventional two inch cantilever strap is the same, by increasing the width of the central portion 101 of a cantilever strap 100 to three inches, the size of the area A, over which the force from an impact upon a body arch member is dispersed and concentrated, on is increased by a factor of 50 percent. Likewise, to increase the width W of the central portion 101 of cantilever strap 100 to four inches results in the area A of the central portion 101 to be increased by a factor of 100 percent, or a doubling of the area, as compared to a conventional two inch cantilever strap. Thus, the force and energy from an impact may be dispersed and absorbed by a much larger area, and such force and energy is not concentrated as much as with a conventional two inch wide cantilever strap.

Figure 2:
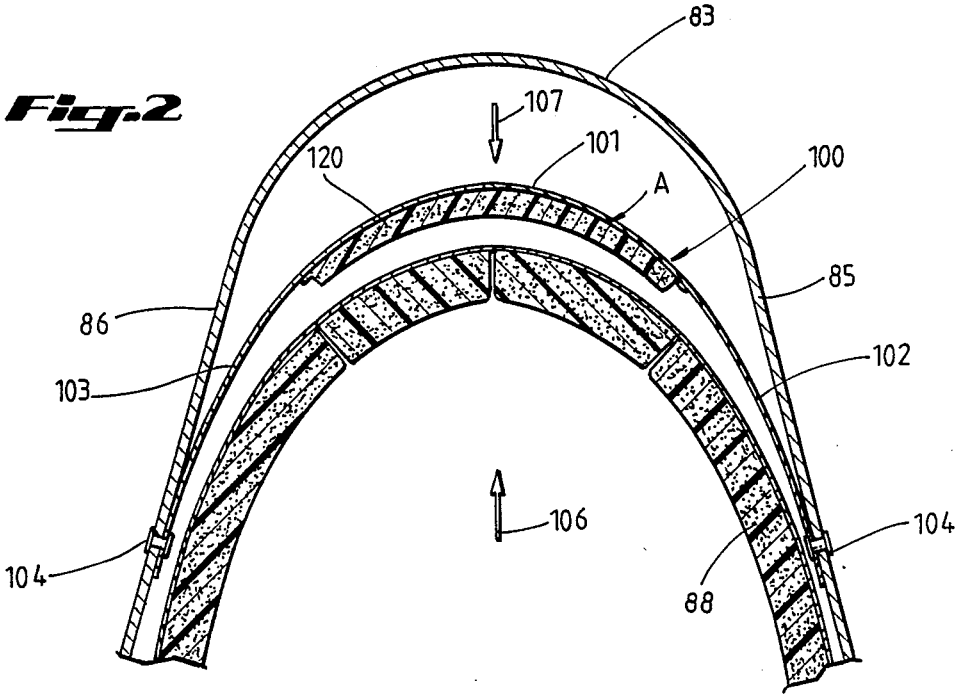
FIG. 2 is a cross-sectional view of the shoulder pad of FIG. 1 taken along line 2—2 of FIG. 1.
Figure 5:
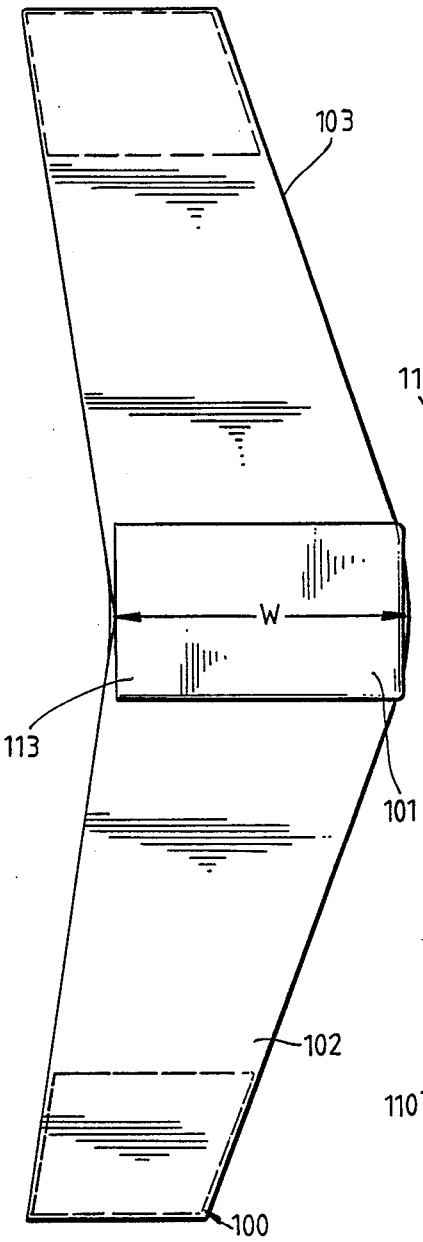
FIG. 5 is top view of a cantilever strap in accordance with the present invention.
Figure 4:
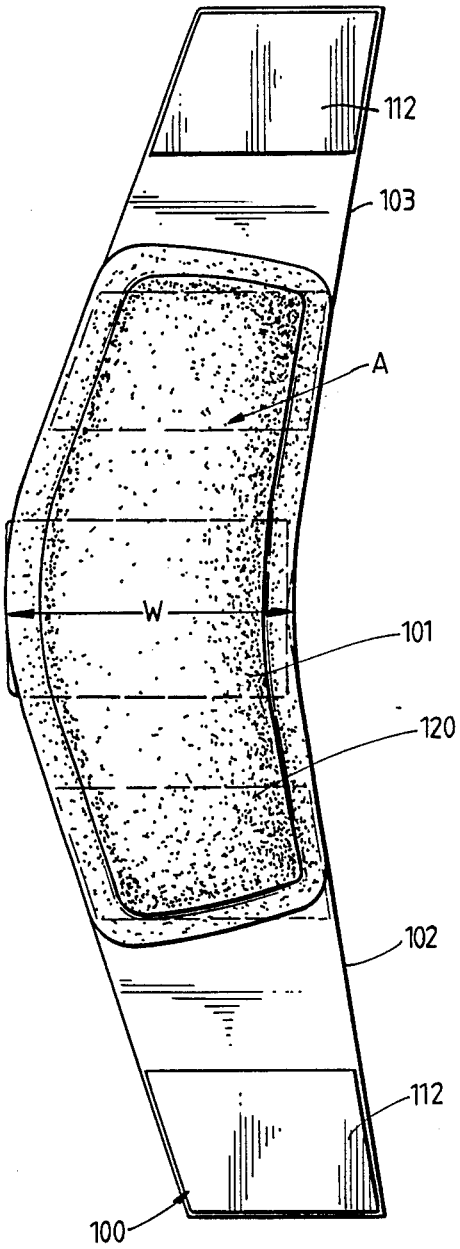
FIG. 4 is a bottom view of a cantilever strap in accordance with the present invention.

As seen in FIGS. 1, 4, and 5, each depending portion 102,103 of each cantilever strap 100 is angularly disposed with respect to the central portion 101 of cantilever strap 100, which as seen in FIGS. 4 and 5 causes cantilever strap 100 to generally have a V-shaped configuration when the cantilever strap 100 is disposed flat as shown in FIGS. 4 and 5. When the cantilever strap 100 is disposed in a curved relationship as shown in FIGS. 1 and 2, when cantilever strap 100 is disposed within football shoulder pads 80, as previously described, each depending portion 102,103 of cantilever strap 100 depends downwardly and inclined toward the other, or opposite, body arch member, such as the depending chest portion 84 of body arch member 82 shown in FIG. 1. Likewise, it is seen that first depending portion 102' of cantilever strap 100' depends downwardly and inclined toward the other, or opposite, body arch member 83, or the depending chest portion 85 of body arch member 83. The previously described configuration of cantilever strap 100 permits cantilever strap 100 to be contoured to better conform and fit the football player 81.

Figure 3:
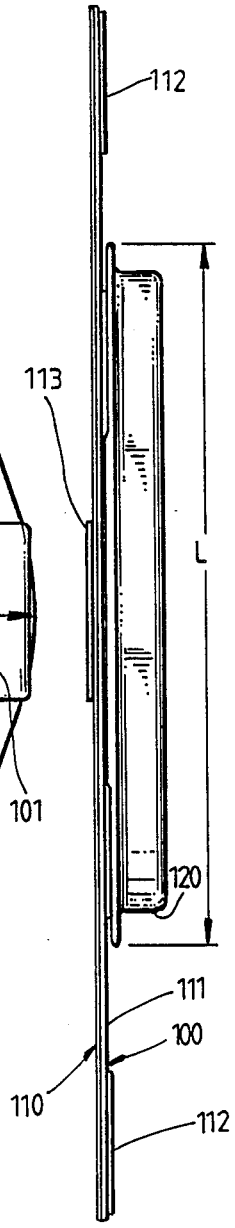
FIG. 3 is a side view of a cantilever strap in accordance with the present invention.

If desired, as seen in FIGS. 1–4, cantilever strap 100 may be provided with a shock absorbing pad 120, which pad overlies the A.C. area of the shoulder of the football player 81, and the shock absorbing pad 120 generally conforms to the size and shape of the central portion 101 of strap 100, whereby the area of shock absorbing pad 120 corresponds to the area A of the central portion 101 of cantilever strap 100. As seen in FIGS. 3 and 4, cantilever strap 100 has an upper surface 110 and a lower surface 111, and the shock absorbing pad 120 is disposed upon the lower surface 111 of cantilever strap 100. As seen in FIGS. 3–5, cantilever strap 100 may include reinforcing members 112 disposed on the lower surface 111 of cantilever strap 100, as well as reinforcing members 113 disposed on the upper surface 110 of cantilever strap 100. Preferably these reinforcing elements 112,113 are made of the same material as that of cantilever strap 100.

Figure 6:
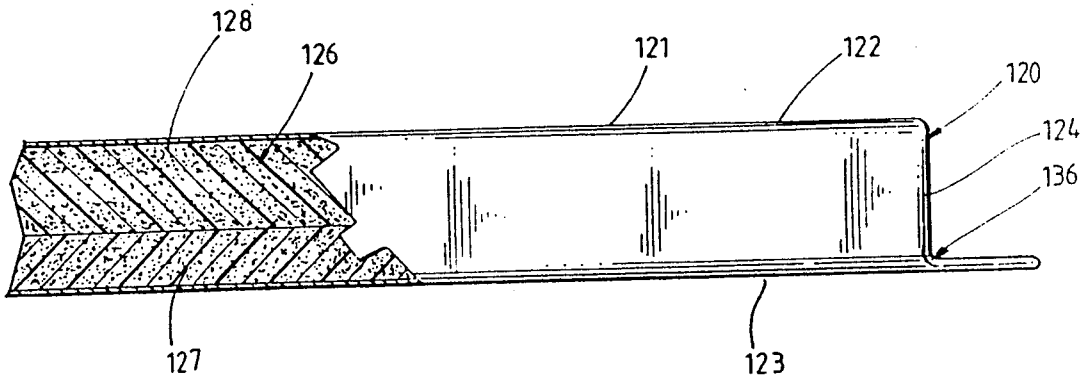
FIG. 6 is a partial cross-sectional view of a shock absorbing pad in accordance with the present invention.
Figure 7:
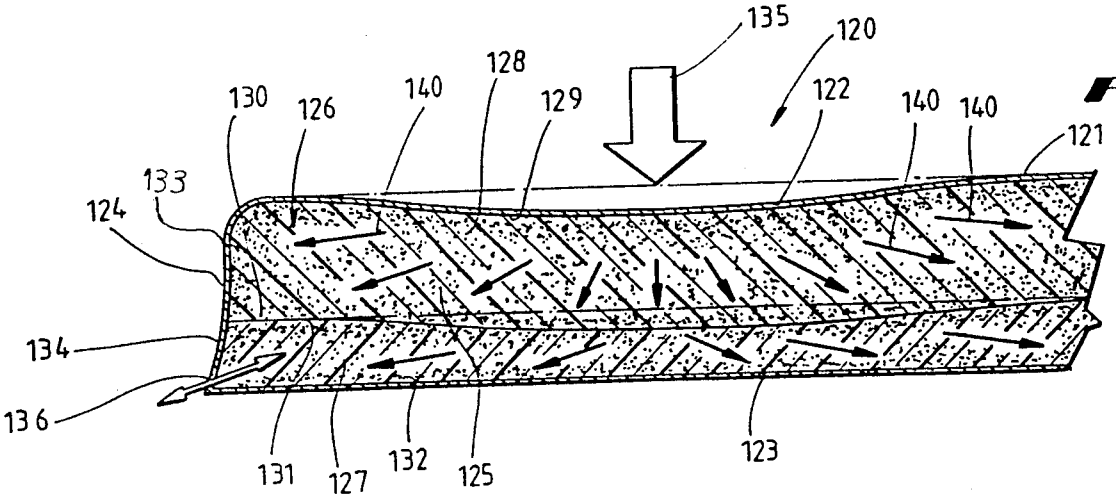
FIG. 7 is a partial cross-sectional view of a shock absorbing pad in accordance with the present invention.

With reference now to FIGS. 6 and 7, the shock absorbing pad or shock absorbing pad structure 120 is shown to generally comprise a flexible enclosure 121 having first and second faces 122,123, and a periphery 124 defining a cavity 125 therein. A flexible open-celled foam member 126 is disposed within cavity 125. Flexible foam member 126 preferably comprises two layers of open-celled form 127,128, the density of the layers 127,128 of open-celled foam being different from one another. Each layer of foam 127,128 has two faces, layer 128 having face surfaces 129,130, and layer 127 having face surfaces 131,132. One face of each layer of foam is bonded to one face of the flexible enclosure 121, as by face 132 of foam layer 127 being bonded to face 123 of enclosure 121, and face 129 of layer 128 being bonded to face 122 of flexible enclosure 121. Further, each layer 127,128 has a periphery 133,134, which is disposed adjacent to periphery 124 of the flexible enclosure 121. The cells of the foam member 126 releasably hold a volume of air which may be selectively varied between first and second volumes differing by a volume differential in response to application and removal of the force (as illustrated by arrow 135 of FIG. 7) exerted upon on the shock absorbing pad 120. The volume differential is thus transferred between the foam member 126 and the atmosphere outside the shock absorbing pad, or shock absorbing pad structure, 120 through at least one air permeable region 136 of the periphery 124 of the flexible enclosure 121. In this regard, the periphery 124 of flexible enclosure 121 may be provided with at least one air permeable region 136 as by providing a plurality of openings in flexible enclosure 121 where the periphery 124 joins the second face 123 of flexible enclosure 121. Such openings (not shown) may be provided as by openings formed by a needle which sews the material forming periphery 124 to the material forming the second face 123 of flexible enclosure 121.

Preferably, the flexible enclosure 121 may comprise a nylon fabric having a polyurethane, or urethane coating on a least one face 122 and preferably also the second face 123, whereby upon heat sealing the fabric or faces 122,123 to foam member 126, the coated faces 122,123 of the fabric are heat sealed to the foam member 126. Preferably, the layers 127,128 of foam member 126 are open-celled polyurethane foams. Preferably, the layer of foam 128 has a density in the range of 2.0 to 2.8 pounds per cubic foot, and the density of foam layer 127 falls within the range of 2.8 to 3.5 pounds per cubic foot. Preferably, the thickness of the layer of foam 128 is greater than that of the layer of foam 127, and the layer of foam 128 requires a greater force to compress that layer of foam than the bottom layer of foam 127. In this regard, the layer of foam 128 would be adjacent the pad body 88 as seen in FIGS. 1 and 2. Preferably, the compression rating of the foam layer 128 would be within a range of 40 to 60 pounds and the compression rating of the thinner layer of foam 127 would be within a range from 25 to 40 pounds. It has been found that the foregoing described shock absorbing pad, or shock absorbing pad structure, 120 is particularly useful in shoulder pads and other equipment for the sport of football and the force and energy from the blow 135 is dispersed in all directions from the point of impact, as well as permits the selectively varying volume of air to travel horizontally and vertically throughout the shock absorbing pad 120 as shown by arrows 140 in FIG. 7. It has been further found that the shock absorbing pad, or shock absorbing pad structure, 120, previously described, can also be used not only in connection with cantilever straps 100, but as the pad body 88 for a football shoulder pad 80, and other types of shock absorbing pad structures.

It is to be understood that the invention is not limited to the exact details of construction, operation, exact materials or embodiments shown and described, as obvious modifications and equivalents will be apparent to one skilled in the art; for example, the entire cantilever strap could be provided with a shock absorbing pad disposed upon its lower surface. Accordingly, the invention is therefore to be limited only by the scope of the appended claims.

I claim:

1. A shock absorbing pad structure for athletic equipment comprising:

a flexible enclosure having first and second faces and a periphery defining a cavity;

a flexible open-celled foam member is disposed within the cavity and comprises two layers of open-celled foam, the density of the layers of open-celled foam being different from one another, each layer of the foam member having two faces, one face of each layer being bonded to one face of the flexible enclosure, and each layer of open-celled foam having a periphery disposed adjacent the periphery of the flexible enclosure, the cells of the foam member releasably holding a volume of air selectively varied between first and second volumes differing by a volume differential in response to application and removal of a force on the shock absorbing pad structure, said volume differential being transferred between the foam member and the atmosphere outside the shock absorbing pad structure through at least one air permeable region of the periphery of the flexible enclosure.

2. The shock absorbing pad structure of claim 1 wherein the flexible enclosure comprises a nylon fabric having a polyurethane coating on one face, the flexible open-celled foam member comprises polyurethane foam, and the coated face of the fabric is heat sealed at least in part to the polyurethane foam.

3. The shock absorbing pad structure of claim 2 wherein one of the foam layers comprises a foam having a density in the range of approximately 2.0 to 2.8 pounds per cubic foot; and the other layer of foam comprises a foam having a density in the range of approximately 2.8 to 3.5 pounds per cubic foot.

4. The shock absorbing pad structure of claim 2 wherein the foam layers have different compression ratings.

* * * * *